United States Patent [19]

Brande

[11] 4,078,397

[45] Mar. 14, 1978

[54] BEVERAGE CONTAINER COOLING DEVICE

[76] Inventor: Bruce R. Brande, 312 Hayward, Ames, Iowa 50010

[21] Appl. No.: 745,359

[22] Filed: Nov. 26, 1976

[51] Int. Cl.[2] ..... F25D 3/08; F25D 3/02

[52] U.S. Cl. ..... 62/372; 62/379; 62/457; 62/463

[58] Field of Search ..... 62/372, 371, 529, 530, 62/457, 459, 463, 464, 377, 378, 379, 381

[56] References Cited

U.S. PATENT DOCUMENTS

| | | | |
|---|---|---|---|
| 136,632 | 3/1873 | Whipple | 62/381 |
| 1,114,104 | 10/1914 | Brielmaier | 62/463 |
| 1,560,967 | 11/1925 | Bowlus | 62/463 |
| 1,988,214 | 1/1935 | Page | 62/463 |
| 2,028,825 | 1/1936 | Christensen | 62/457 |
| 2,405,091 | 7/1946 | Culbreth | 62/379 |
| 2,504,911 | 4/1950 | Whitecar | 62/457 |
| 3,326,357 | 6/1967 | Miller | 62/372 |
| 3,668,886 | 6/1972 | Hofer | 62/457 |

*Primary Examiner*—Lloyd L. King
*Attorney, Agent, or Firm*—Zarley, McKee, Thomte, Voorhees & Sease

[57] ABSTRACT

A beverage container cooling device comprising a lower housing unit having an ice compartment area formed therein adapted to contain ice. The lower housing unit is provided with structure for centering the beverage container on the ice in a substantially horizontal attitude. A top housing unit is detachably secured to the lower housing unit and is provided with a horizontally disposed roller having a crank operatively secured thereto which extends outwardly through the top housing unit. The roller is vertically movably mounted in the top housing unit and is designed to engage the beverage container positioned on the ice so that operation of the crank will cause the roller to rotate the beverage container on the ice which will cause the contents of the container to be cooled.

4 Claims, 5 Drawing Figures

BEVERAGE CONTAINER COOLING DEVICE

BACKGROUND OF THE INVENTION

This invention relates to a beverage container cooling device and more particularly to a beverage container cooling device which rapidly cools the contents of the beverage container.

Many types of beverage container cooling devices have been provided but they generally comprise a hollow container adapted to contain ice and the beverage containers. The existing devices do cool the contents of the beverage containers but the process is fairly slow.

Therefore, it is a principal object of the invention to provide an improved beverage container cooling apparatus.

A still further object of the invention is to provide a beverage container cooling apparatus which quickly cools the contents of the beverage container.

A still further object of the invention is to provide a portable beverage container cooling apparatus.

A still further object of the invention is to provide a beverage container cooling device including means for positioning the beverage container relative to the rotatable roller.

A still further object of the invention is to provide a beverage container cooling apparatus including a vertically movable roller positioned therein which may be vertically moved to compensate for melting of the ice.

A still further object of the invention is to provide a beverage container cooling apparatus which is economical to manufacture, durable in use and refined in appearance.

SUMMARY OF THE INVENTION

The beverage container cooling apparatus of this invention comprises a lower housing unit having an ice compartment area formed therein adapted to contain ice. The lower housing unit is provided with a guide means which aids in positioning the beverage container in a horizontally disposed position on the ice. A top housing unit is detachably secured to the lower housing unit and has a roller means operatively rotatably mounted therein which is adapted to engage the beverage container on the ice. A crank extends outwardly from the top housing unit and is operatively connected to the roller so that operation of the crank will cause the roller to be rotated which in turn causes the beverage container to be rotated on the ice thereby quickly cooling the contents of the container.

DESCRIPTION OF THE PREFERRED EMBODIMENT

Figure 1:
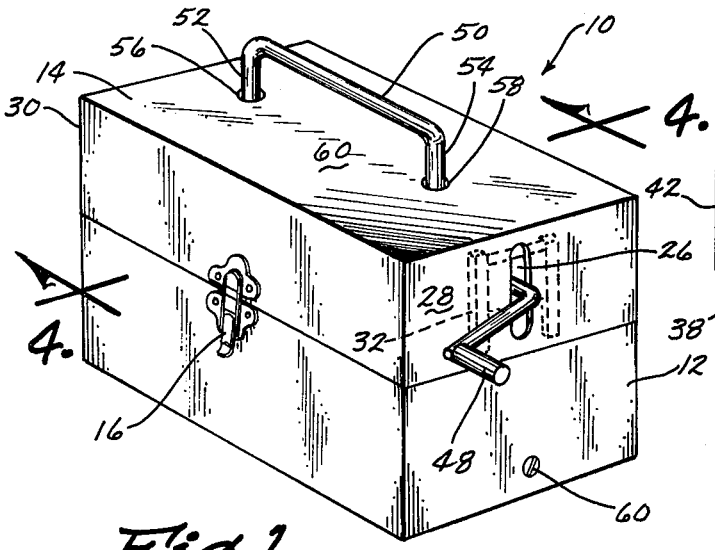
FIG. 1 is a perspective view of the device.
Figure 2:
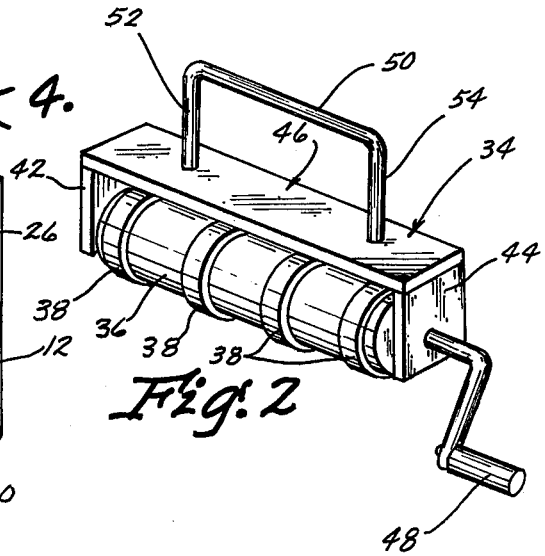
FIG. 2 is a perspective view of the roller means portion of the invention.
Figure 3:
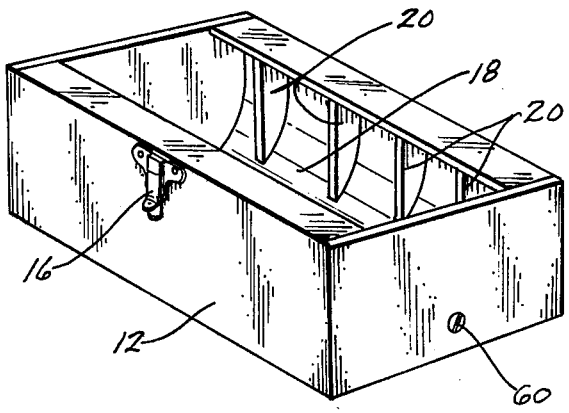
FIG. 3 is a top view of the lower housing unit.
Figure 4:
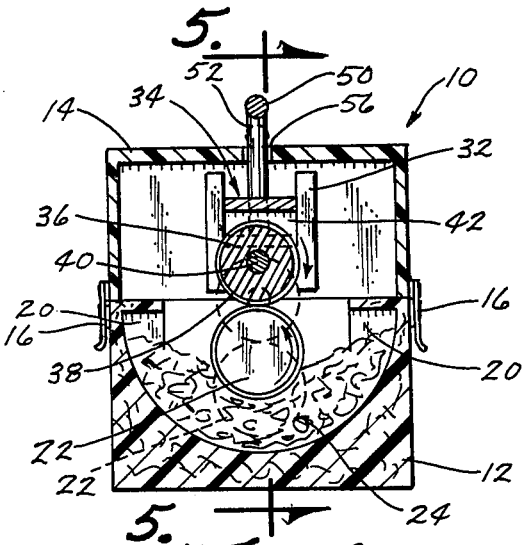
FIG. 4 is a sectional view of the device as seen on lines 4—4 of FIG. 1.
Figure 5:
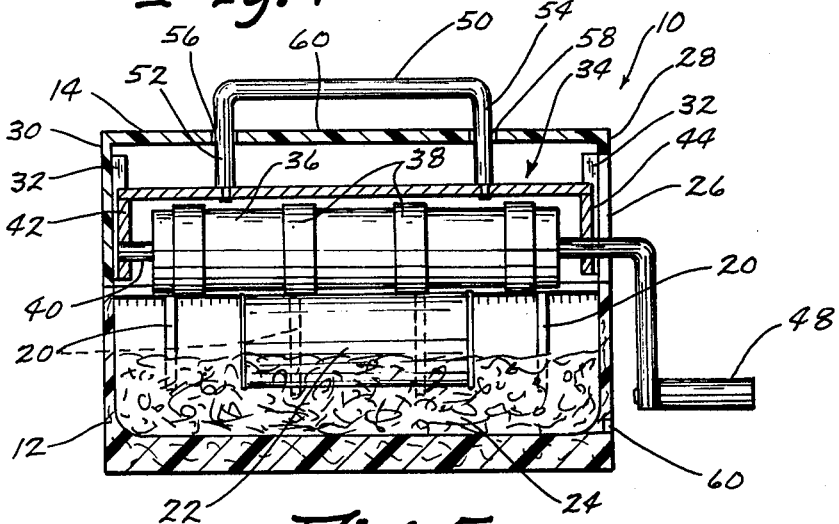
FIG. 5 is a sectional view seen on lines 5—5 of FIG. 4.

The beverage container cooling device of this invention is referred to generally by the reference numeral 10 and generally comprises a lower housing unit 12 having an upper or top housing unit 14 detachably mounted thereon by means of latches 16. Lower housing unit 12 is provided with an ice compartment area formed therein referred to generally by the reference numeral 18. As seen in the drawings, the lower portion of the ice compartment area 18 is semi-circular in section. A plurality of spaced-apart ribs or guides 20 extend inwardly from the sides of the lower housing unit 12 into the ice compartment area 18 and serve to position the beverage container 22. For purposes of description, the numeral 24 will be used to refer to the bed of ice which is placed in the ice compartment area 18.

Top housing unit 14 is provided with an elongated vertically disposed slot 26 formed in side 28. The interior surfaces of sides 28 and 30 of top housing unit 14 are provided with guide apparatus referred to generally by the reference numeral 32 for a purpose to be described hereinafter.

The numeral 34 refers generally to a roller means for rotating the container 22 on the bed of ice. Roller means 34 comprises an elongated roller 36 having spaced-apart ribs 38 extending therefrom which are comprised of a rubber composition material. Roller 36 is mounted on a shaft 40 which extends from the opposite ends thereof and which is rotatably mounted in the vertically disposed legs 42 and 44 of the roller support 46. Legs 42 and 44 are vertically slidably mounted in the guides 32 so as to maintain the roller means in proper position. Crank 48 is operatively connected to one end of the shaft 40 and extends outwardly through the slot 26. Handle 50 extends upwardly from the support 46 and has its legs 52 and 54 extending through the openings 56 and 58 formed in top 60 of top unit 14.

The method of using the apparatus is as follows. Top unit 14 is first detachably removed from the lower housing unit 12. Ice 24 is then positioned in the ice compartment area 18 in the manner depicted in the drawings and the container 22 is then placed thereon. As previously stated, ribs 20 serve to centrally position the container 22 on the bed of ice 24. Top unit 14 is then mounted on the lower unit 12 and the latches 16 are secured. Handle 50 is then grasped and moved downwardly relative to the top housing unit 14 until the ribs 38 of roller 36 are in engagement with the container 22. Crank 48 is then rotated to cause the rotation of roller 36 which causes the rotation of the container 22 on the ice 24 to quickly chill or cool the contents of the container. The rotation of the container 22 is enhanced by the rubber ribs 38 extending from the roller 36 to insure good frictional engagement therebetween. The vertical movement of the roller 36 is also important in that the roller 36 can be vertically moved relative to the guides 32 and the container to compensate for different ice heights and to compensate for ice melt during the cooling operation. As seen in the drawings, lower housing unit 12 is provided with a drain port 60 formed therein to permit water to be removed from the lower housing 12 as the ice melts.

It should be noted that the device may be easily modified so as to be able to simultaneously cool more than one container. If it is desirable to cool three containers, the roller means 34 would be modified so as to comprise a pair of rollers adapted to rotate the three beverage containers.

Thus it can be seen that a novel beverage container cooling apparatus has been provided which is convenient to use and which rapidly cools the contents of the beverage container by causing the beverage container to be rotated on a bed of ice. Thus it can be seen that the apparatus of this invention accomplishes at least all of the stated objectives.

I claim:

1. A beverage container cooling apparatus, comprising:

a lower housing unit having an ice compartment area formed therein adapted to have ice therein, means for positioning at least one beverage container on the ice in a substantially horizontal attitude, a top housing unit detachably secured to said lower housing unit, and means for rotating the container relative to the ice whereby the contents of the container will be cooled by the ice, said means for rotating said container comprising a roller means operatively rotatably mounted in said top housing unit, and a crank operatively connected to said roller means for rotating said roller means, said crank extending outwardly from said top housing unit.

2. The apparatus of claim 1 where said roller means is selectively vertically movably mounted in said top housing unit.

3. The apparatus of claim 1 wherein said means for positioning said container on the ice comprises a guide means defining a U-shaped pocket.

4. The apparatus of claim 2 wherein a handle means extends upwardly from said roller means through said top housing unit, said handle means being vertically movable with respect to said top housing unit to enable the operator to vertically move said roller means.

* * * * *